US009403653B2

(12) United States Patent
Matsumura

(10) Patent No.: US 9,403,653 B2
(45) Date of Patent: Aug. 2, 2016

(54) CONVEYING APPARATUS, PRINTING APPARATUS, CONTROL METHOD, AND SHEET FEEDING METHOD

(71) Applicant: CANON KABUSHIKI KAISHA, Tokyo (JP)

(72) Inventor: Hideaki Matsumura, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/737,689

(22) Filed: Jun. 12, 2015

(65) Prior Publication Data

US 2015/0375536 A1 Dec. 31, 2015

(30) Foreign Application Priority Data

Jun. 26, 2014 (JP) ..... 2014-131800

(51) Int. Cl.
*B41J 15/16* (2006.01)
*B65H 23/18* (2006.01)

(52) U.S. Cl.
CPC ..... *B65H 23/1806* (2013.01); *B65H 2801/15* (2013.01)

(58) Field of Classification Search
CPC ..... B41J 11/0005; B41J 11/42; B41J 29/393; B41J 15/16; B41J 15/165; B65H 23/185
USPC ..... 347/16
See application file for complete search history.

(56) References Cited

U.S. PATENT DOCUMENTS 4,729,520 A * 3/1988 Kataoka ..... B65H 23/1888 226/24
5,964,390 A * 10/1999 Børresen ..... B65H 23/025 226/118.2
2006/0098073 A1* 5/2006 Kawaguchi ..... B41J 2/04508 347/104
2012/0050438 A1* 3/2012 Wada ..... B65H 23/1955 347/104
2014/0239113 A1* 8/2014 Igarashi ..... B65H 23/1825 242/420.5
2014/0374529 A1* 12/2014 Nakayama ..... B65H 23/192 242/418.1

FOREIGN PATENT DOCUMENTS

JP 6-293446 A * 10/1994 ..... B65H 5/06
JP 2009-208921 A 9/2009
JP 2010221662 A * 10/2010
JP 2012-240296 A * 12/2012 ..... B41F 33/06

* cited by examiner

*Primary Examiner* — Stephen Meier
*Assistant Examiner* — Sharon A Polk
(74) *Attorney, Agent, or Firm* — Fitzpatrick, Cella, Harper & Scinto

(57) ABSTRACT

The present invention provides a conveying apparatus includes a supporting unit rotatably supporting a roll of a sheet, a conveying unit conveying the sheet pulled out from the roll, a detection unit detecting a rotation amount of the roll, a driving unit giving a rotational driving force to the roll supported by the supporting unit, and a control unit controlling the driving unit based on the detection result of the detection unit. The control unit sets a control amount for the driving unit in accordance with a rotation phase of the roll, in order to adjust a tension of the sheet between the roll and the conveying unit.

11 Claims, 6 Drawing Sheets

| AREA | REFERENCE CONTROL AMOUNT |
|---|---|
| area1 | ••• |
| area2 | ••• |
| area3 | ••• |
| area4 | ••• |
| area5 | ••• |
| area6 | ••• |
| area7 | ••• |
| area8 | ••• |

CONVEYING APPARATUS, PRINTING APPARATUS, CONTROL METHOD, AND SHEET FEEDING METHOD

BACKGROUND OF THE INVENTION

1. Field of the Invention

The present invention relates to a conveying apparatus, printing apparatus, control method, and sheet feeding method.

2. Description of the Related Art

A printing apparatus which prints images on a roll-like sheet such as roll paper has been proposed. A printing apparatus like this includes a conveying mechanism which pulls out a sheet from a roll and conveys the sheet. The conveying mechanism includes, for example, a pair of conveyance rollers which clamp and convey the sheet. The sheet conveyance accuracy of the conveying mechanism has influence on the quality of a printed image. The tension of the sheet between the roll and conveyance roller pair has influence on the conveyance accuracy. When the roll is exchanged or the sheet is consumed, the roll diameter changes, and this fluctuates the tension of the sheet. Japanese Patent Laid-Open No. 2009-208921 has disclosed an apparatus which adjusts the tension of the sheet by a spindle motor for driving a spindle which supports the roll. This apparatus disclosed in Japanese Patent Laid-Open No. 2009-208921 executes a process of estimating the roll diameter whenever a printing execution instruction is issued or when a user's instruction is input, and controls the spindle motor based on the estimated roll diameter, thereby suppressing the fluctuation in tension of the printing medium.

The sheet tension can also fluctuate due to a cause other than the roll exchange or sheet consumption. For example, an error of the mechanism of the apparatus or the eccentricity of the rotation center of the roll can also be a cause. It is difficult for the apparatus disclosed in Japanese Patent Laid-Open No. 2009-208921 to cope with the fluctuations in tension of the printing medium resulting from these causes.

SUMMARY OF THE INVENTION

The present invention provides a technique of improving the conveyance accuracy of a roll-like sheet.

According to an aspect of the present invention, there is provided a conveying apparatus comprising: a supporting unit configured to rotatably support a roll in which a sheet is wound; a conveying unit configured to convey the sheet pulled out from the roll supported by the supporting unit; a detection unit configured to detect a rotation amount of the roll supported by the supporting unit; a driving unit configured to give a rotational driving force to the roll supported by the supporting unit; and a control unit configured to control the driving unit based on a detection result of the detection unit, wherein the control unit sets a control amount for the driving unit in accordance with a rotation phase of the roll, in order to adjust a tension of the sheet between the roll and the conveying unit.

Further features of the present invention will become apparent from the following description of exemplary embodiments (with reference to the attached drawings).

DESCRIPTION OF THE EMBODIMENTS

First Embodiment

<Arrangement of Apparatus>

Figure 1:
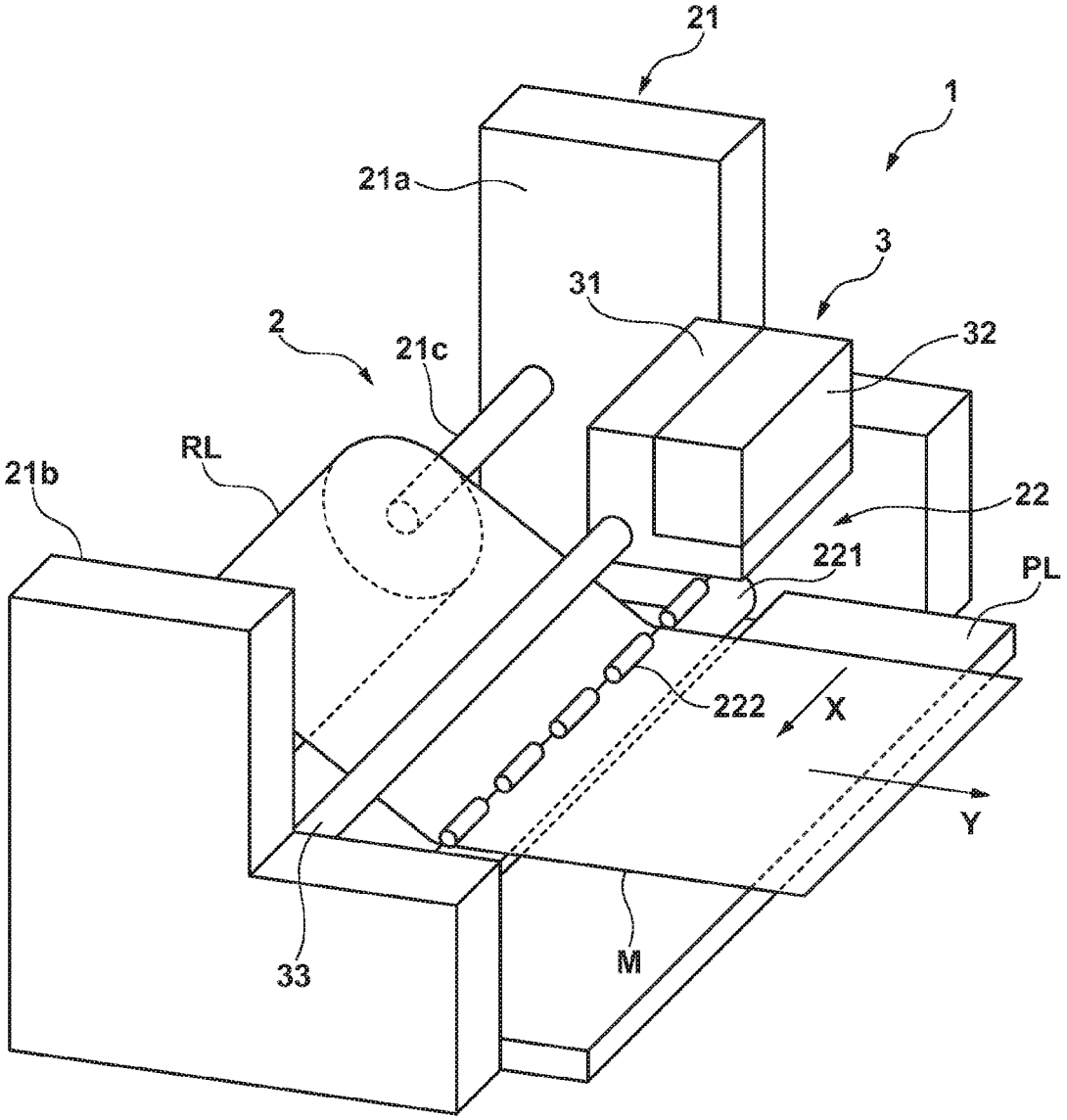
FIG. 1 is a schematic view of a printing apparatus according to an embodiment of the present invention.
Figure 2:
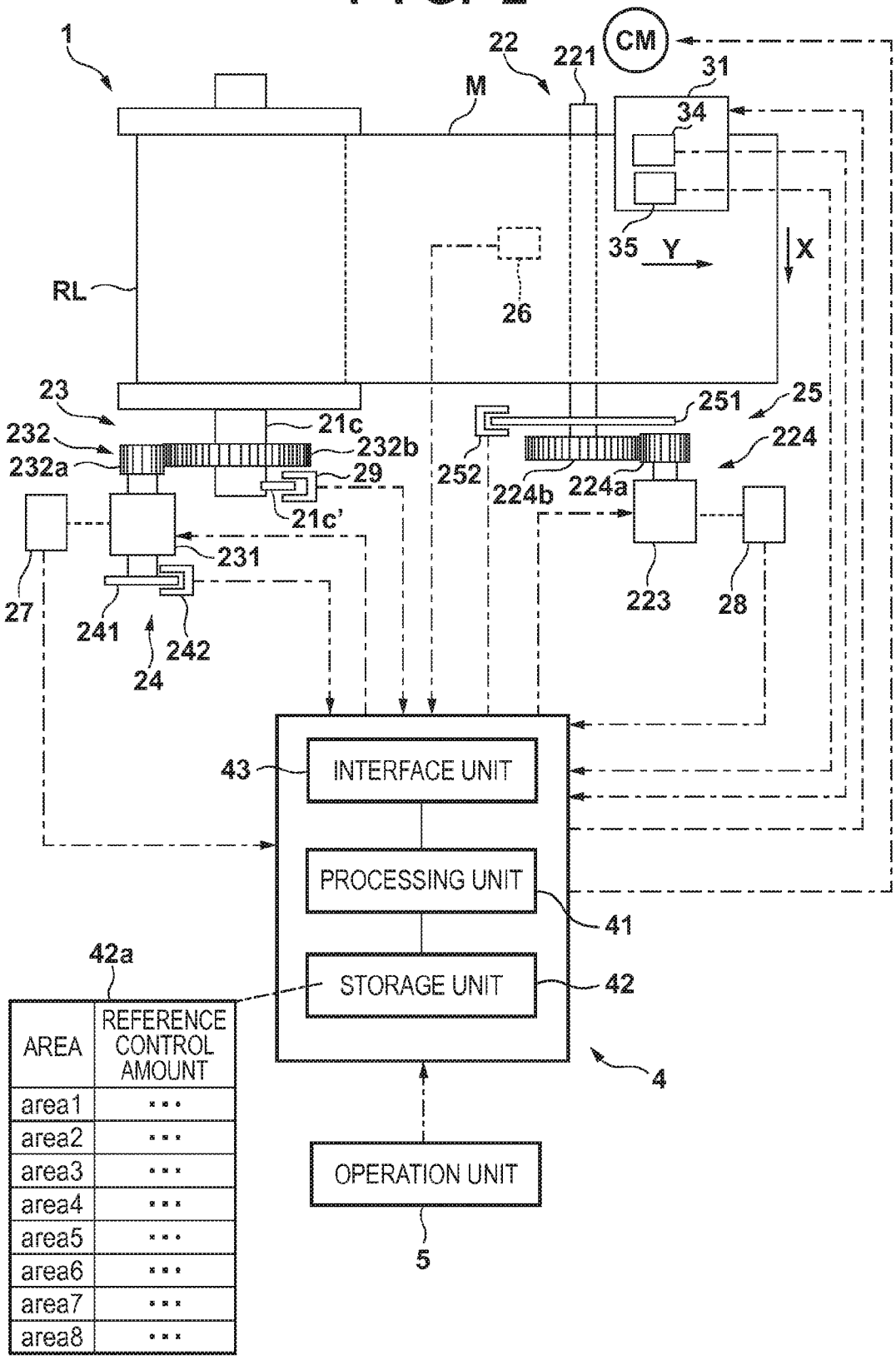
FIG. 2 is a view for explaining mechanisms and a control unit of the printing apparatus shown in FIG. 1.

FIG. 1 is a schematic view of a printing apparatus 1 according to an embodiment of the present invention. FIG. 2 is a view for explaining mechanisms and a control unit 4 of the printing apparatus 1. In this embodiment, a case in which the present invention is applied to an inkjet printing apparatus will be explained. However, the present invention is also applicable to other types of printing apparatuses. Also, in this embodiment, a case in which the present invention is applied to a serial type inkjet printing apparatus will be explained. However, the present invention is also applicable to a line type inkjet printing apparatus.

Note that "printing" includes not only the formation of significant information such characters and figures, but also the formation of significant or insignificant information such as images, designs, and patterns on printing media, or the processing of media. That is, whether information is so actualized as to be visually perceivable by humans does not matter. Also, it is assumed that "a printing medium" is a paper sheet M in this embodiment, but it is also possible to use a sheet of another material such as cloth or a plastic film.

Referring to FIGS. 1 and 2, the printing apparatus 1 includes a conveying apparatus 2, a printing mechanism 3, and the control unit 4. In FIGS. 1 and 2, an arrow X indicates a main scan direction, and an arrow Y indicates a sub scan direction perpendicular to the main scan direction.

The printing apparatus 1 is an apparatus which pulls out a band-like sheet M from a roll (roll paper) RL on which the sheet M is wound, and prints an image on the sheet M. The roll RL is a cylindrical member formed by winding the sheet M on a cylindrical core (for example, a paper tube).

The conveying apparatus 2 includes a supporting unit 21, conveying mechanism 22, and tension generating mechanism 23 (a roll RL driving mechanism). The supporting unit 21 rotatably supports the roll RL. In this embodiment, the supporting unit 21 includes a pair of supporting members 21*a* and 21*b* and a rotating shaft 21*c*. The pair of supporting members 21*a* and 21*b* rotatably support the rotating shaft 21*c*, and also support other members of the printing apparatus 1. The rotating shaft 21*c* has two end portions detachably supported by the pair of supporting members 21*a* and 21*b*, and extends parallel to the X direction. The rotating shaft 21*c* is fitted in the center of the roll RL, and the rotating shaft 21*c* and roll RL rotate together. The roll RL is attached to the rotating shaft 21*c* by using a known attaching/detaching mechanism, so that the roll RL can be exchanged.

In this embodiment, the conveying mechanism 22 includes a conveyance roller 221 and pinch roller 222 forming a roller pair. The conveyance roller 221 and pinch roller 222 extend in the X direction. The conveyance roller 221 includes, for example, a shaft, and a cylindrical rubber member covering the surface of this shaft. The pinch roller 222 is urged against the conveyance roller 221 by an elastic member such as a spring (not shown), and rotates in synchronism with the rotation of the conveyance roller 221.

When the end portion of the sheet M is clamped between nip portions of the conveyance roller 221 and pinch roller 222 and the conveyance roller 221 is rotated, the sheet M is pulled out from the roller RL, clamped in the Y direction by the nip portions, and conveyed.

The conveying mechanism 22 includes a driving mechanism for rotating the conveyance roller 221. The driving mechanism includes a motor 223 as a driving source, and a transfer mechanism which transfers the output from the motor 223 to the conveyance roller 221. In this embodiment, the transfer mechanism is a decelerating mechanism using gears, that is, includes a gear 224*a* fixed to the output shaft of the motor 223, and a gear 224*b* which is fixed to the end portion of the conveyance roller 221 and meshes with the gear 224*a*. The conveyance roller 221 can be rotated by driving the motor 223, and the rotation direction of the conveyance roller 221 can be switched by the rotation direction of the motor 223. The transfer mechanism may also be another type of mechanism such as a belt transfer mechanism.

The tension generating mechanism 23 is a rotational driving mechanism (driving unit) for the roll RL, that is, includes a motor 231 as a driving source, and a transfer mechanism 232 for transferring the output from the motor 231 to the roll RL, and gives a rotational driving force to the supported roll RL. In this embodiment, the transfer mechanism 232 is a decelerating mechanism using gears, that is, includes a gear 232*a* fixed to the output shaft of the motor 231, and a gear 232*b* which is fixed to the end portion of the rotating shaft 21*c* and meshes with the gear 232*a*. The roll RL can be rotated by driving the motor 231, and the rotation direction of the roll RL can be switched by the rotation direction of the motor 231. Feeding the sheet M in the Y direction by the rotation of the roll RL will sometimes be called "forward feed", and the rotation direction of the roller RL at that time will sometimes be called "a forward direction". Also, rewinding the sheet M by the rotation of the roller RL will sometimes be called "back feed", and the rotation direction of the roll RL at that time will sometimes be called "a backward direction".

When conveying the sheet M in this embodiment, the sheet M is conveyed as it is fed by rotationally driving the roll RL in addition to the rotational driving of the conveyance roller 221. In addition, it is possible to generate a tension on the sheet M between the roll RL supported by the supporting unit 21 and the conveyance roller 221 by controlling the motors 223 and 231 in synchronism with each other. Note that the transfer mechanism 232 may also be another type of mechanism such as a belt transfer mechanism.

The conveying apparatus 2 also includes sensors 24 and 25. The sensor 24 senses the rotation amount of the roll RL supported by supporting unit 21. In this embodiment, the sensor 24 is a rotary encoder and includes a slit disc 241 and photosensor 242. The slit disc 241 is a disc having a plurality of slits formed in the peripheral portion. In this embodiment, the slit disc 241 is coaxially fixed to the output shaft of the motor 231. The photosensor 242 is a transmitting type photosensor including a light-receiving element and light-emitting element opposing each other, and is so arranged as to sense the presence/absence of the slits of the slit disc 241. The rotation amount of the motor 241 is sensed by counting the slits sensed by the photosensor 242. The rotation amount of the roll RL can be sensed from the rotation amount of the motor 241 and the deceleration ratio of the transfer mechanism 23. Note that it is also possible to adopt an arrangement in which the slit disc 241 is coaxially fixed to the rotating shaft 232*b*. Note also that the sensor 24 may be another type of sensor as long as the sensor can sense the rotation amount of the roll RL.

The sensor 25 senses the rotation amount of the conveyance roller 221. In this embodiment, the sensor 25 is a rotary encoder including a slit disc 251 and photosensor 252, like the sensor 24. The slit disc 251 is coaxially fixed to the conveyance roller 221, and the rotation amount of the conveyance roller 221 is sensed by counting the slits sensed by the photosensor 252. Note that it is also possible to adopt an arrangement in which the slit disc 251 is coaxially fixed to the motor 223. Note also that the sensor 25 may be another type of sensor as long as the sensor can sense the rotation amount of the conveyance roller 221.

The conveying apparatus 2 further includes sensors 26 to 29. The sensor 26 is arranged upstream of the conveyance roller 221, and senses the sheet M. For example, the sensor 26 is a photosensor. The sensor 27 senses the output torque of the motor 231, and is, for example, a current sensor which senses an electric current to be supplied to the motor 231. The sensor 28 senses the output torque of the motor 223, and is, for example, a current sensor which senses an electric current to be supplied to the motor 223. The sensor 29 senses a sensing target piece 21*c*' formed on the rotating shaft 21*c*, and is a photosensor or the like. When the sensor 29 senses the sensing target piece, the rotation position of the rotating shaft 21*c* can be set as an initial position.

Next, the printing mechanism 3 will be explained. The printing mechanism 3 includes a carriage 31 and printing unit 32. The carriage 31 is guided by a guide shaft 33 extending in the X direction, and movably supported in the X direction. The carriage 31 is moved back and forth in the X direction by a driving mechanism (including, for example, a belt transfer mechanism) using a carriage motor CM as a driving source.

The printing unit 32 is mounted on the carriage 31. The printing unit 32 includes a printhead. The printhead prints an image by discharging ink supplied from an ink tank onto the sheet M. The ink tank can form the printing unit 32 together with the printhead, or can be mounted on the carriage 31 independently of the printhead. A platen PL is arranged below the moving path of the carriage 31. The platen PL includes, for example, a mechanism which holds the sheet M by suction.

Sensors 34 and 35 are mounted on the carriage 31. The sensor 34 senses the position of the carriage 31, and is an encoder sensor or the like. The encoder sensor can read an encoder scale set in the X direction, and can sense the position of the carriage 31 in the X direction from the read result. The sensor 35 senses the sheet M, and is a photosensor or the like. The width of the sheet M can be calculated based on the position of the carriage 31 when the sensing result of the sensor 35 has changed.

The control unit 4 will now be explained. The control unit 4 includes a processing unit 41, storage unit 42, and interface unit 43. The processing unit 41 is a CPU or the like, and controls the whole printing apparatus 1. The storage unit 42 includes one or a plurality of storage devices. For example, the storage device is a ROM, RAM, or hard disk. The storage unit 42 stores programs to be executed by the processing unit 41, print data received from a host computer (not shown), and the like. The storage unit 42 also temporarily stores various kinds of data generated when the processing unit 41 executes the programs.

The storage unit 42 further stores various kinds of information. The various kinds of information include sheet information, motor information, and tension setting information 42*a*. The sheet information is, for example, information of each type of sheet, and includes the sheet density, the sheet thickness, and the diameter or radius of the paper tube. The motor information includes the torque coefficient of the motor. The tension setting information 42*a* is information about a control amount for the motor 231 of the tension generating mechanism 23.

The interface unit 43 includes an I/O interface for input data from the above-described various sensors and an operation unit 5 and outputting data to the above-described various motors and the printhead, and a communication interface for communicating with a host computer (not shown). Note that the control unit 4 may also include a signal processing circuit for processing signals from the above-described sensors, and a driving circuit for driving the motor. The operation unit 5 is an input device for accepting user's instructions, and is a touch panel type operation panel or the like.

Next, the printing operation of the printing apparatus 1 will be explained. The conveying mechanism 22 pulls out the sheet M from the roll RL. The carriage 31 moves above (scans) the sheet M. During this movement, the printing unit 32 discharges ink droplets and prints an image. While the image is printed, the sheet M is not conveyed, and the platen PL holds the sheet M by suction, thereby improving the planarity. When the printing unit 32 has printed one line, the sheet M is conveyed by a predetermined amount in the Y direction and stopped. Subsequently, the next one line is printed. Thus, the printing apparatus 1 performs printing line by line by repeating the intermittent conveyance of the sheet M.

<Control of Tension>

When conveying the sheet M, the processing unit 41 of the control unit 4 controls not only the driving of the motor 223 for rotating the conveyance roller 221, but also the driving of the motor 231 for rotating the roll RL. The driving of the motor 231 is so controlled as to generate a predetermined tension F [N] between the roll RL and conveyance roller 221. The tension F functions as a back tension to the conveyance roller 221. A slip amount or the like between the conveyance roller 221 and sheet M is held constant by controlling the motor 231 so as to hold the tension F constant when viewed from the conveyance roller 221. Accordingly, the conveyance accuracy of the sheet M can be increased. An example of the cause of fluctuating the tension F and a method of suppressing the fluctuation will be explained below.

Figure 3A:
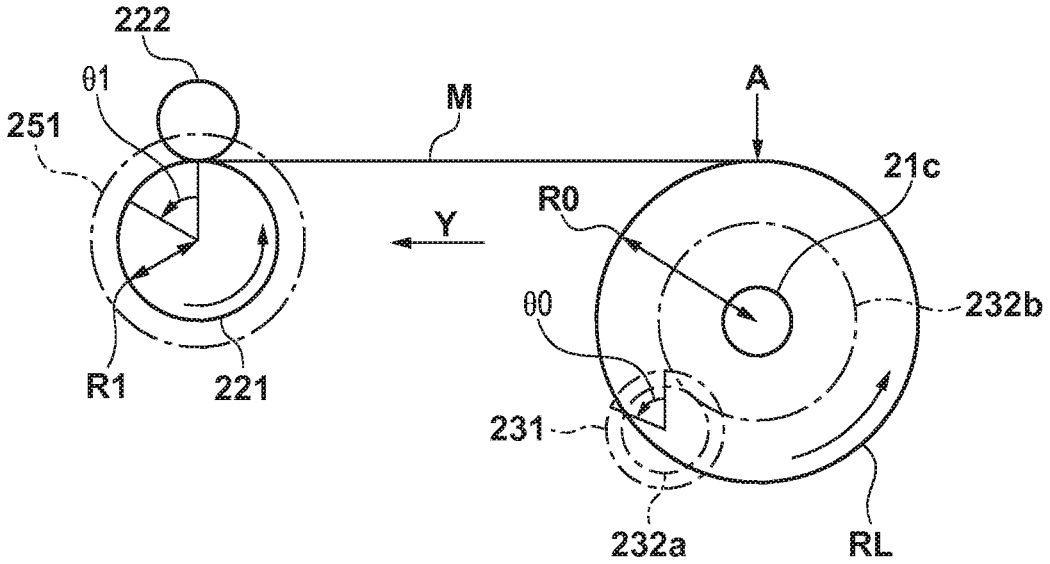
FIG. 3A is a view for explaining a calculation example of the radius of a roll.

As shown in FIG. 3A, a position where the sheet M is pulled out from the roll RL is a point A. The distance from the rotation center of the roll RL to the point A is the radius of the roll RL. As the sheet M is pulled out from the roll RL, the radius of the roll RL decreases. When the roll RL is exchanged, the radius is different from that before the exchange. If the output from the motor 231 is constant, the radius of the roll RL fluctuates the tension F. Therefore, control corresponding to the radius of the roll RL is necessary. This makes it necessary to calculate the radius of the roll RL.

FIG. 3A shows an example of a method of calculating the radius of the roll RL. Under conditions by which the sheet M is practically not slackened or slipped, the sheet M is conveyed by a predetermined amount by the conveyance roller 221. Let θ0 [rad] be the rotation angle of the motor 231 sensed by the sensor 24 in this state, n1 be the number of teeth of the gear 232*b*, n2 be the number of teeth of the gear 232*a*, and θ1 [rad] be the rotation angle of the conveyance roller 221 sensed by the sensor 25.

Letting R1 [m] be the radius of the conveyance roller 221, a radius R0 [m] of the roll RL is calculated by:

$$R0=R1\times\theta1/\theta0/n1\times n2 \quad (1)$$

Note that in the arrangement of this embodiment, the calculation result of the radius R0 contains transfer errors of the gears 232*a* and 232*b*.

The fluctuation in radius R0 occurs in cases other than the case in which the sheet M is pulled out from the roll RL or the roll RL is exchanged. For example, this fluctuation occurs due to the roundness of the roll RL itself or axial misalignment between the rotating shaft 21*c* and roll RL. That is, the tension F may fluctuate because the radius R0 increases or decreases during one rotation of the roll RL.

There are causes, other than the fluctuation in radius of the roll RL, which fluctuate the tension F. An example is a transfer error of the driving force from the motor 231 to the rotating shaft 21*c*. Practical examples are axial misalignment between the rotating shaft 21*c* and gear 232*c*, and axial misalignment between the output shaft of the motor 231 and the gear 232*a*. If there is a transfer error like this, the tension F may fluctuate even when the motor 231 is driven at a constant velocity. The tension F may fluctuate during one rotation of the roll RL in this case as well.

In this embodiment, therefore, the control amount of the motor 231 is set in accordance with the rotation phase during one rotation of the roll RL. An example of the control amount of the motor 231 is the torque control amount (for example, the driving duty ratio). This makes it possible to reduce the fluctuation in tension F during one rotation of the roll RL, thereby increasing the conveyance accuracy of the sheet M.

When setting the control amount of the motor 231 in accordance with the rotation phase during one rotation of the roll RL, the processing sometimes becomes complicated if the control amount is continuously set in accordance with the rotation angle of the roll RL. In this embodiment, therefore, the control amount is set for each rotation phase area obtained by dividing the angle range (that is, 360°) of one rotation of the roll RL into a plurality of regions. This can prevent the processing from becoming complicated.

Figure 3B:
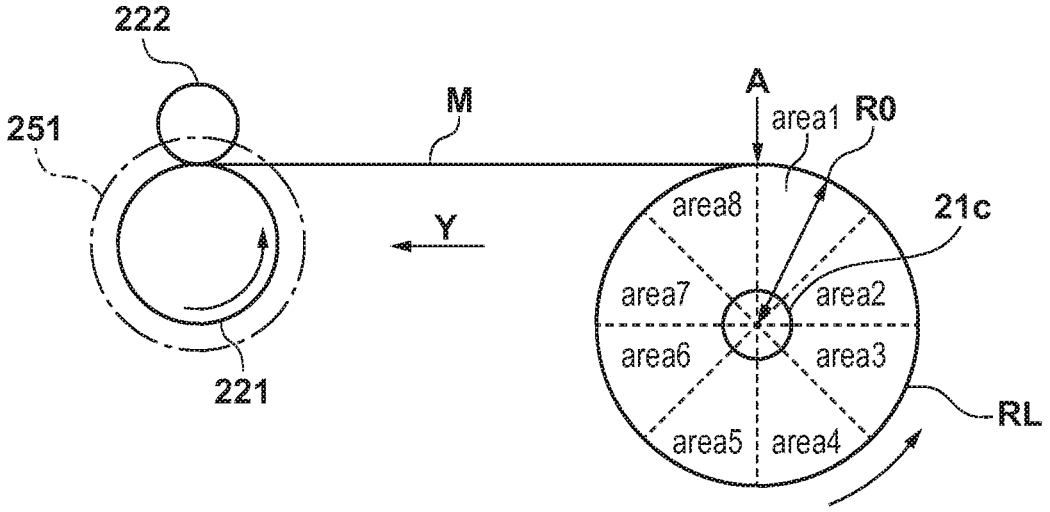
FIG. 3B is a view for explaining a rotation phase area.

When the deceleration ratio (=n1/n2) of the transfer mechanism 232 is an integer N, the number of divided rotation phase areas can be N. For example, when the deceleration ratio is 8, the rotation phase area is equally divided into eight areas area1 to area8, as shown in FIG. 3B. That is, one rotation phase area has an angle range of 45°. The basis of each rotation phase area can be the rotation position of the rotating shaft 21*c* when the sensor 29 senses the sensing target piece 21*c*'. For example, rotation phase area area1 can be an angle range until the rotating shaft 21*c* rotates 45° after the sensor 29 has sensed the sensing target piece 21*c*'.

When equally dividing the rotation phase area into eight rotation phase areas area1 to area8, the motor 231 rotates N times while the roll RL rotates once. Accordingly, the fluctuation in tension F caused by a transfer error of the driving force repeats whenever the roll RL rotates once (that is, repeats for each period). Therefore, the fluctuation in tension F can be reduced more effectively by setting the control amount of the motor 231 for each of rotation phase areas area1 to area8.

A transfer error of the driving force depends on the design of the transfer mechanism 232. Accordingly, it is possible to derive the reference control amount of the motor 231 for each of rotation phase areas area1 to area8, which cancels the target fluctuation in tension F caused by a transfer error of the driving force, by an experiment using a prototype of the printing apparatus 1 or by simulation. This experiment or simulation need only be performed on each identically designed machine type. To derive a more accurate control amount, however, the experiment may also be conducted on each product before it is shipped.

The reference control amount can be stored as the above-described tension setting information 42*a* in the storage unit 42, and used when conveying the sheet M. As shown in FIG. 2, the tension setting information 42*a* contains information of the reference control amounts associated with rotation phase areas area1 to area8.

The above-mentioned experiment or simulation is performed by using or assuming the roll RL having a specific diameter (called a reference diameter), so the reference control amount can be used as a control amount when using the roll RL having the reference diameter. In this case, it is also possible to set a plurality of reference diameters, and set the reference control amount for each reference diameter. Furthermore, the reference diameter may also be the diameter of an unused roll RL (that is, a maximum diameter). In the following explanation, it is assumed that the reference diameter is the diameter of an unused roll RL.

The above-mentioned experiment or simulation can be performed for, for example, each type of the sheet M or each width of the sheet M, and the reference control amount can be set for each type of the sheet M or each width of the sheet M. Consequently, it is possible to process a plurality of types of the sheets M or the sheets M having a plurality of widths. As for the width of the sheet M, it is also possible to obtain the reference control amount for only a possible maximum width. When applying the reference control amount to the sheet M having a different width, the reference control amount need only be corrected in accordance with the ratio to the maximum width. For example, when applying the reference control amount to the sheet M having a width which is ½ of the maximum width, the reference control amount need only be corrected such that the output torque becomes ½.

As already explained above, the fluctuation in radius of the roll RL is sometimes caused by, for example, the roundness of the roll RL itself. This makes it difficult to grasp this fluctuation in advance, unlike a transfer error of the driving force. When conveying the sheet M, therefore, the motor 231 is controlled while the radius of the roll RL is calculated by equation (1). In this case, it is possible to calculate the radius of the roll RL in accordance with equation (1) for each of rotation phase areas area1 to area8, and correct the reference control amount based on the ratio of the value twice the calculated radius to the reference diameter, thereby obtaining a final control amount. This makes it difficult to suppress the fluctuation in tension F in accordance with both a transfer error of the driving force and the fluctuation in radius of the roll RL.

Processing Examples

Figure 4A:
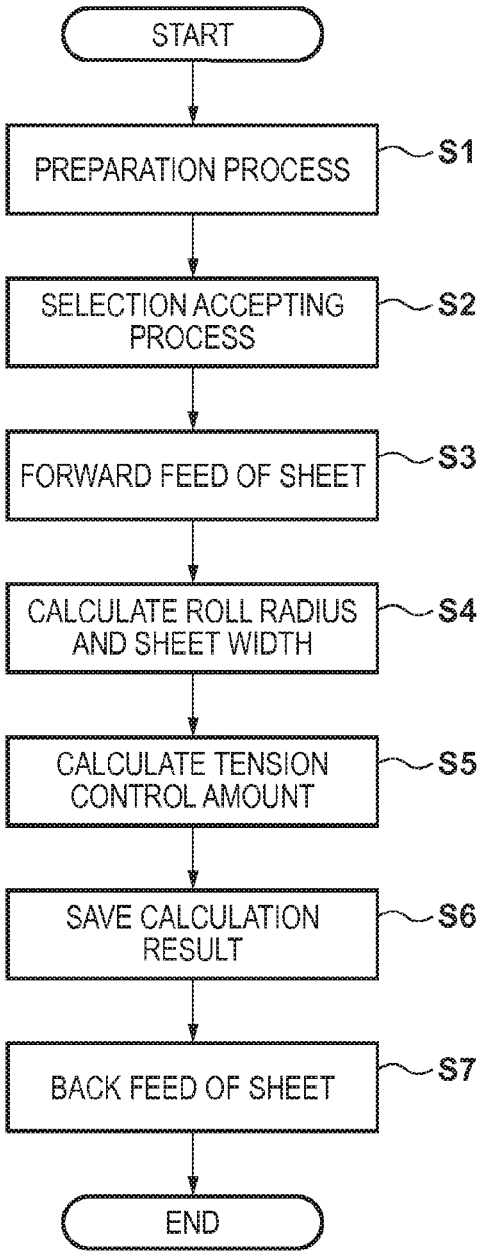
FIGS. 4A and 4B are flowcharts showing processing examples to be executed by the control unit.

Examples of processing executed by the processing unit 41 of the control unit 4 will be explained with reference to FIGS. 4A and 4B. FIG. 4A is a flowchart showing a processing example when a new unused roll RL is attached. In the following explanation, tension control is performed on each of rotation phase areas area1 to area8 as shown in FIG. 3B.

In step S1, a preparation process corresponding to a roll RL attaching work by the user is performed. The user sets the roll RL in the supporting unit 21, and abuts the distal end portion of the sheet M against the nip portions of the conveyance roller 221 and pinch roller 222. Since the sensor 26 senses the sheet M, the control unit 4 rotates the conveyance roller 221 and conveys the sheet M by a predetermined amount in the Y direction. Also, the carriage 31 is moved in the X direction and positioned above the platen PL.

In step S2, a user' selection input is accepted via the operation unit 5. For example, selection of the type of the sheet M after exchange is accepted.

In step S3, the conveyance roller 221 and rotating shaft 21*c* are rotated by driving the motors 223 and 231, thereby starting conveyance of the sheet M. In this step, the sheet M is pulled out and conveyed by a predetermined amount. Pulling out the sheet M from the roll RL is also called "forward feed". In this step, the roll RL rotates once or more after the sensor 29 has sensed the sensing target piece 21*c*'. When the sensor 29 senses the sensing target piece 21*c*', it is possible to discriminate between rotation phase areas area1 to area8.

In step S3, the tension setting information 42*a* corresponding to the sheet M of the type selected by the user in step S2 is also read out. In step S3, the reference control amount set in the readout tension setting information 42*a* is used as the control amount for the motor 231, and the control amount is switched in accordance with each of rotation phase areas area1 to area8 passing through the point A (see FIGS. 3A and 3B).

In parallel to the processing in step S3, in step S4, the radius of the roll RL is calculated for each of rotation phase areas area1 to area8 from above-mentioned equation (1) based on the sensing results of the sensors 24 and 25. More specifically, when rotation phase areas area1 to area8 which pass through the point A are switched, an area which passes through the point A after the switching is specified, and the radius of the roll RL is calculated for the specified rotation phase area.

The calculation result is saved in the storage unit 42. When forward feed is complete, the carriage 31 is moved back and forth in the X direction, and the width of the sheet M is calculated from the sensing results of the sensors 34 and 35. The calculation result is saved in the storage unit 42.

In step S5, the reference control amount read out in step S3 is corrected based on the calculation result in step S4. An example of the correction method has already been described above. The corrected control amount is set as the control amount for the motor 231 for each of rotation phase areas area1 to area8 at the first rotation of the roll RL, and saved in the storage unit 42 in step S6.

In step S7, the conveyance roller 221 and rotating shaft 21*c* are rotated backward by driving the motors 223 and 231, thereby rewinding the sheet M to the roll RL until the sheet M is positioned in a predetermined waiting position. Rewinding the sheet M to the roll RL is also called "back feed".

Next, a process of updating the control amount for the motor 231 during a printing operation will be explained with reference to FIG. 4B. In the printing operation, the control amount is changed in accordance with rotation phase areas area1 to area8 passing through the point A (see FIGS. 3A and 3B). In this case, the control amount is updated in accordance with the fluctuation in radius of the roll RL. FIG. 4B shows a processing example pertaining to the update of the control amount.

In step S11, the conveyance of the sheet M in the printing operation is started. In this step, the conveyance roller 221 and rotating shaft 21*c* are rotated by driving the motors 223 and 231, thereby performing the forward feed of the sheet M.

In step S12, when rotation phase areas area1 to area8 which pass through the point A (see FIGS. 3A and 3B) are switched, an area which passes through the point A after the switching is specified. The specified area will be called a target area. Note that in the example shown in FIGS. 3A and 3B, it is assumed that the point A is positioned at the apex of the roll RL. Although processing may also be performed by fixing the position of the point A, the position of the point A sometimes changes due to the change in radius of the roll RL. Accordingly, it is also possible to successively calculate the position of the point A from the radius and diameter of the roll RL, the radius and diameter of the conveyance roller 221, and their central positions.

In step S13, the sensing results of the sensors 24 and 25 are acquired, and the radius of the roll RL is calculated from above-mentioned equation (1) for the target area specified in step S12.

In step S14, the reliability of the radius of the roll RL calculated in step S13 is determined. If it is determined that there is reliability, the process advances to step S15. If it is determined that there is no reliability, the processing of one unit is terminated. The reliability is determined in order to prevent false sensing of the radius of the roll RL due to the action of an unexpected external force, for example, to prevent false sensing when the user pulls out the sheet M from the roll RL. An example of the determination method is to compare the calculation result of the radius of the roll RL saved by the last processing for the target area specified in step S12 with the radius of the roll RL calculated this time in step S13. If the difference between the two radii is not less than twice the thickness of the sheet M, it is determined that there is no reliability. If it is determined that there is no reliability, processes in steps S15 and S16 to be described below are not performed, that is, the radius information and control amount information are not updated.

In step S15, the control amount of the target area is updated based on the radius of the roll RL calculated in step S13. The update method may be correction of the reference control amount, and may also be correction of the control amount set by the last processing. In step S16, the radius information and control amount information of the target area stored in the storage unit 42 are updated by the radius calculated in step S13 and the control amount updated in step S15. While the target area is passing through the point A, the control amount for the motor 231 is the updated control amount. Thus, the processing of one unit is complete. During the printing operation, the process shown in FIG. 4B is repetitively executed, and the control amount for each rotation phase area is updated one after another.

In this embodiment as explained above, the control amount for the motor 231 is set in accordance with the rotation phase during one rotation of the roll RL, so the tension fluctuation of the sheet M during one rotation of the roll RL can be reduced. This makes it possible to increase the conveyance accuracy of the sheet M. Consequently, a conveyance shift decreases, and the quality of an image formed by the printing mechanism 3 can also be improved.

Note that in this embodiment, rotation phase areas area1 to area8 are set based on the position where the sensor 29 senses the sensing target piece 21*c*', in order to reduce the tension fluctuation caused by a transfer error of the driving force from the motor 231 to the rotating shaft 21*c*. However, if a transfer error of the driving force is negligible, it is unnecessary to align the mechanism with rotation phase areas area1 to area8.

In this case, therefore, the sensor 29 and sensing target piece 21*c*' are unnecessary. Even when the sensor 29 and sensing target piece 21*c*' are not used, rotation phase areas area1 to area8 can be set as needed when the roll RL is exchanged. By changing the control amount for the motor 231 for each rotation phase area, it is possible to reduce the tension fluctuation of the sheet M caused by, for example, the roundness of the roll RL itself. In this case, it is also possible to set the number of divided rotation phase areas regardless of the mechanism.

Second Embodiment

Figure 5A:
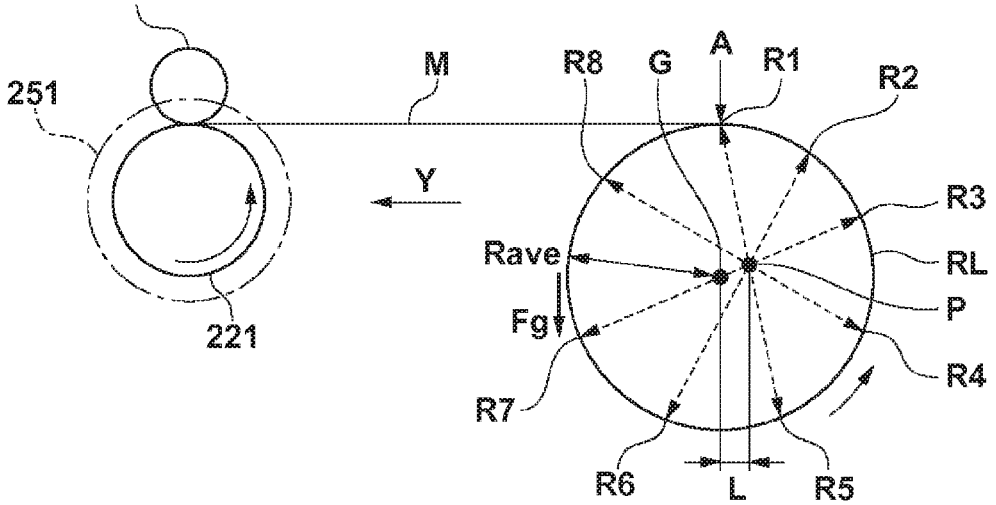
FIGS. 5A and 5B are views for explaining setting examples of a control amount taking account of the eccentricity of the roll.
Figure 5B:
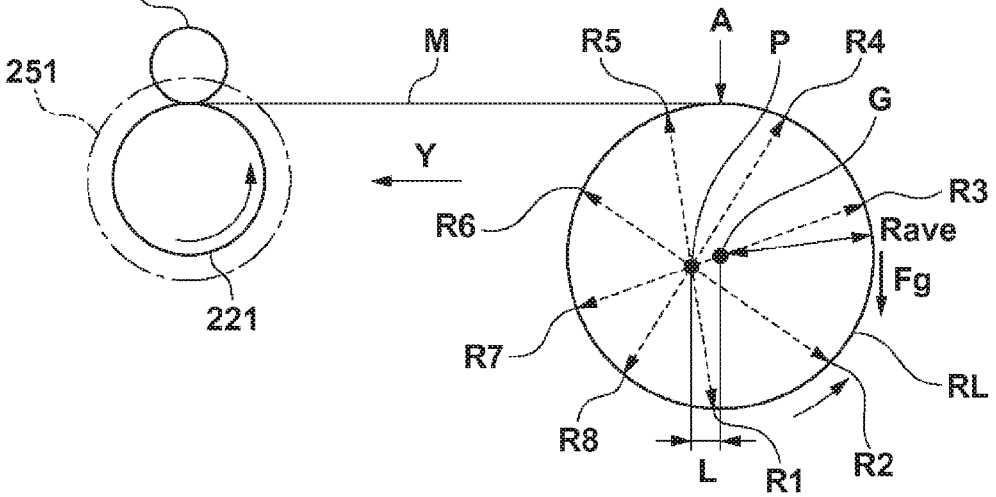

When the radius of the roll RL fluctuates during one rotation, the rotation center of the roll RL is shifted from the center of gravity of the roll RL. This shift causes the tension fluctuation of the sheet M. Therefore, a method of reducing the tension fluctuation of the sheet M caused by this shift will be explained below. FIGS. 5A and 5B are views for explaining the method.

Referring to FIGS. 5A and 5B, it is assumed that the number of divided rotation phase areas of the roll RL is 8, as in the first embodiment. R1 to R8 represent the radii of the roll RL in rotation phase areas area1 to area8, and the radii R1 to R8 each indicate the radius in the position where the rotation phase areas are switched. That is, the rotation phase area is switched to area1 in a position where the distal end of the arrow R1 overlaps a point A, and switched to area1 in a position where the distal end of the arrow R2 overlaps the point A. The meaning of the point A is the same as that in the first embodiment.

The position of a rotation center P of the roll RL is calculated from the radii R1 to R8. The position of a center of gravity G is calculated from Rave as the average value of the radii R1 to R8. A shift amount L indicating the eccentricity between the rotation center P and center of gravity G is the horizontal distance between the rotation center P and center of gravity G. The shift amount L is negative (−) when the center of gravity G exists on the left side of the rotation center P, and positive (+) when the center of gravity G exists on the right side of the rotation center P.

Referring to FIG. 5A, the center of gravity G is shifted to the left side from the rotation center P. Letting W be the weight of the roll RL, the weight W is applied on the center of gravity G. Accordingly, the roll RL generates a self-rotating force Fg which is counterclockwise in FIG. 5A as the forward feed direction.

The weight W can be calculated from the average value Rave of the radius, the density and thickness of the sheet M, and the paper tube diameter. Information of the sheet M necessary to calculate the weight W can be stored as sheet information in a storage unit 42.

In the example shown in FIG. 5B, the center of gravity G is shifted to the right from the rotation center P. Accordingly, the roll RL generates a self-rotating force Fg which is clockwise in FIG. 5B as the back feed direction.

That is, when the rotation phase of the roll RL is in the state shown in FIG. 5A, the self-rotating force Fg acts in the direction of reducing the back tension of the roll RL. When the rotation phase of the roll RL is in the state shown in FIG. 5B, the self-rotating force Fg acts in the direction of increasing the back tension.

The self-rotating force Fg can simply be represented by:

$$Fg=L/\mathrm{Rave}\times W \tag{2}$$

Figure 4B:
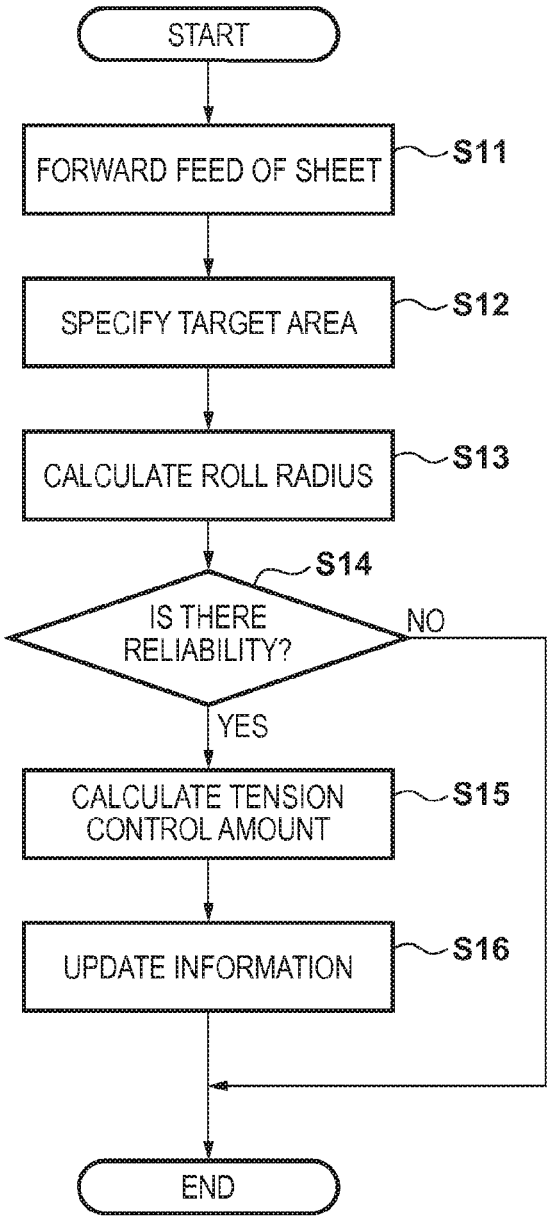

When calculating the control amount of a motor 231 in step S15 of FIG. 4B, it is possible to suppress the tension fluctuation of the sheet M caused by the shift between the rotation center of the roll RL and the center of gravity of the roll RL by adding a value equivalent to the self-rotating force Fg.

Third Embodiment

In the first and second embodiments, the tension fluctuation of the sheet M is suppressed by changing the back tension by the control amount for the motor 231. However, it is also possible to increase the conveyance accuracy by the conveyance control amount for the motor 223. That is, the real conveyance amount is held constant by changing the conveyance amount with respect to the tension fluctuation of the sheet M in control. The control amount of the motor 223 is set in accordance with the rotation phase during one rotation of the roll RL in this embodiment as well. This makes it possible to suppress the fluctuation in conveyance amount caused by the fluctuation in radius of the roll RL. In the following explanation, the number of divided rotation phase areas is 8 as in the first and second embodiments.

In this embodiment, the control amount for the motor 231 can be constant. By contrast, the control amount of the motor 231 may also be set in accordance with the rotation phase during one rotation of the roll RL as in the first embodiment. In this case, the control amount for each of rotation phase areas area1 to area8 can be kept at the reference control amount, in order to reduce, by the motor 231, the tension fluctuation of the sheet M caused by a transfer error of the driving force from the motor 231 to the rotating shaft 21*c*. Alternatively, the reference control amount may also be corrected based on the value equivalent to the self-rotating force Fg explained in the second embodiment.

The contents of control of this embodiment will now be explained. In this embodiment, the control amount for the motor 223 is set by correcting a unit control amount based on a correction table. The unit control amount is related to the rotation amount of the motor 223 required to convey the sheet M by one distance unit. When the motor 223 is a stepping motor, the unit control amount is defined by the number of driving pulses.

Figure 6:
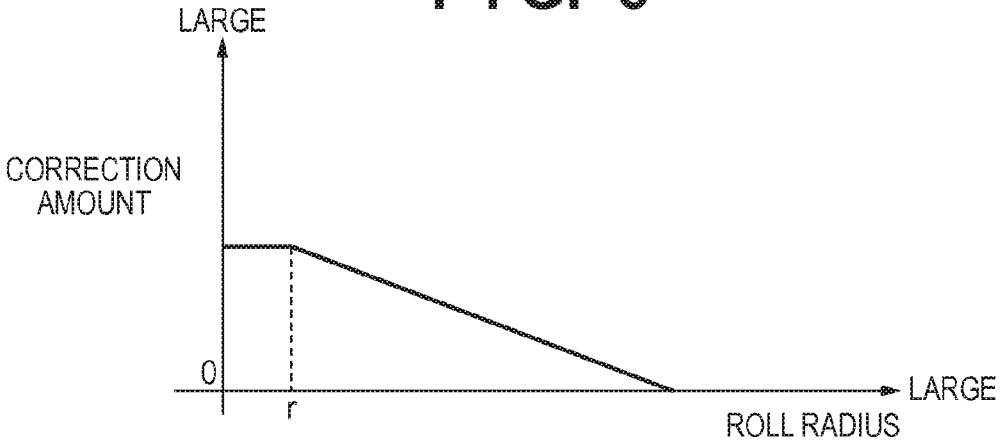
FIG. 6 is a view for explaining an example of the correction amount of a conveyance amount.

FIG. 6 shows an example of the correction table. In this correction table shown in FIG. 6, the correction amount is plotted on the ordinate, and the radius of the roll RL is plotted on the abscissa. The correction amount is 0 when the radius of the roll RL is maximum, and increases as the radius of the roll RL decreases. The correction amount is constant when the radius of the roll RL is smaller than r.

In this embodiment, the unit control amount is corrected by determining a correction amount from the calculation result of the radius of the roll RL and the correction table, and adding the determined correction amount to the unit control amount. Accordingly, as the radius of the roll RL decreases, the control amount for the motor 223 increases (the rotation amount of the motor 223 increases). This means that as the radius of the roll RL decreases, the slip amount of the sheet M with respect to the conveyance roller 221 increases.

The correction table can be formed by an experiment using a prototype of the printing apparatus 1 or by simulation. This experiment or simulation need only be performed on each identically designed machine type. To derive a more accurate control amount, however, the experiment may also be conducted on each product before it is shipped.

The correction table can be stored in the storage unit 42, and used when conveying the sheet M. The above-mentioned experiment or simulation can be performed for, for example, each type of the sheet M or each width of the sheet M, and the reference control amount can be set for each type of the sheet M or each width of the sheet M. Consequently, it is possible to process a plurality of types of the sheets M or the sheets M having a plurality of widths.

Processing Examples

Figure 7A:
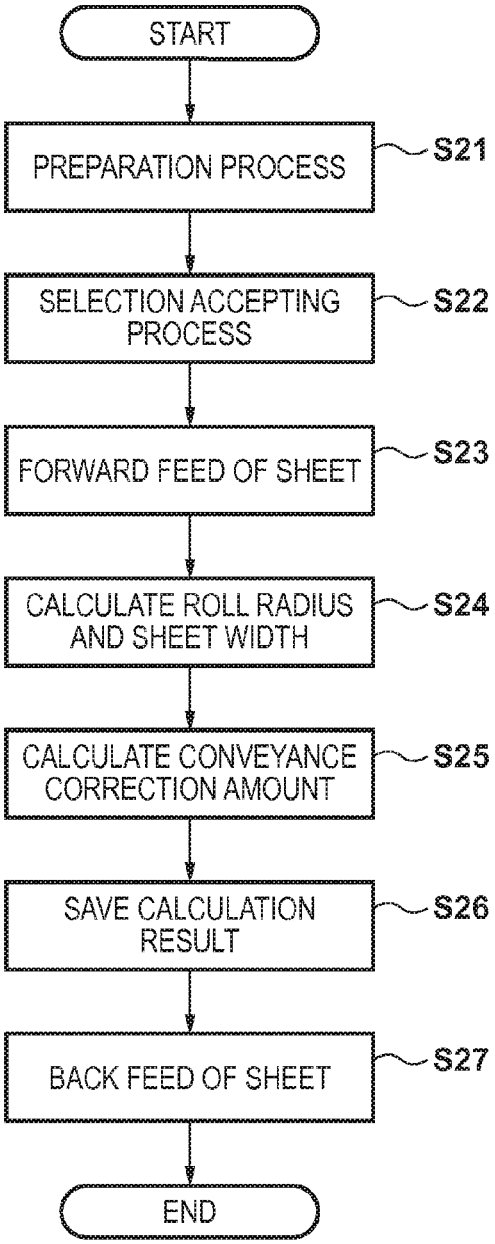
FIGS. 7A and 7B are flowcharts showing processing examples to be executed by the control unit.
Figure 7B:
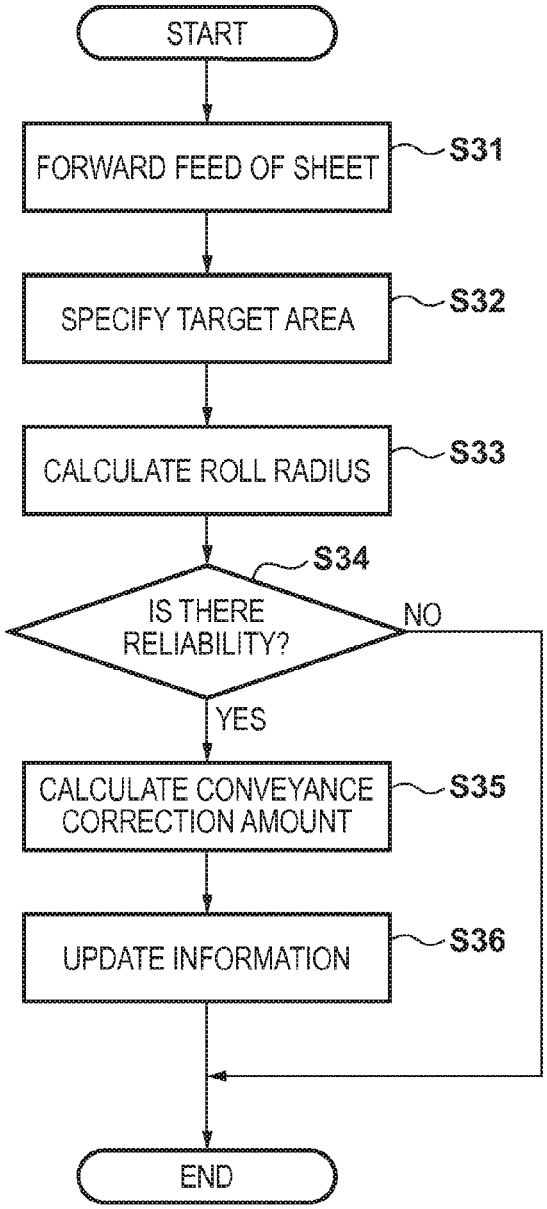

Examples of processing to be executed by the processing unit 41 of the control unit 4 will be explained with reference to FIGS. 7A and 7B. FIG. 7A is a flowchart showing a processing example when a new unused roll RL is attached. In the following explanation, a process of setting a correction amount based on the correction table is performed for each of rotation phase areas area1 to area8 as shown in FIG. 3B.

In step S21, a preparation process corresponding to a roll RL attaching work by the user is performed. The user sets the roll RL in the supporting unit 21, and abuts the distal end portion of the sheet M against the nip portions of the conveyance roller 221 and pinch roller 222. Since the sensor 26 senses the sheet M, the control unit 4 rotates the conveyance roller 221 and conveys the sheet M by a predetermined amount in the Y direction. Also, the carriage 31 is moved in the X direction and positioned above the platen PL.

In step S22, a user' selection input is accepted via the operation unit 5. For example, selection of the type of the sheet M after exchange is accepted.

In step S23, the conveyance roller 221 and rotating shaft 21*c* are rotated by driving the motors 223 and 231, thereby starting forward feed of the sheet M. In this step, the roll RL rotates once or more, and rotation phase areas area1 to area8 are allocated.

Note that when reducing, by the motor 231, the tension fluctuation of the sheet M caused by a transfer error of the driving force from the motor 231 to the rotating shaft 21*c*, the rotation phase areas are discriminated based on the position where the sensor 29 has sensed the sensing target piece 21*c*', as in the first embodiment.

In parallel to the processing in step S23, in step S24, the radius of the roll RL is calculated for each of rotation phase areas area1 to area8 from above-mentioned equation (1) based on the sensing results of the sensors 24 and 25. More specifically, when rotation phase areas area1 to area8 which pass through the point A are switched, an area which passes through the point A after the switching is specified, and the radius of the roll RL is calculated for the specified rotation phase area.

The calculation result is saved in the storage unit 42. When forward feed is complete, the carriage 31 is moved back and forth in the X direction, and the width of the sheet M is calculated from the sensing results of the sensors 34 and 35. The calculation result is saved in the storage unit 42.

In step S25, the correction table corresponding to the sheet M is read out, and a correction amount for each of rotation phase areas area1 to area8 is determined based on the calculation result in step S24, and saved in the storage unit 42 in step S26.

In step S27, the conveyance roller 221 and rotating shaft 21*c* are rotated backward by driving the motors 223 and 231, thereby rewinding the sheet M to the roll RL until the sheet M is positioned in a predetermined waiting position.

Next, a process of updating the correction amount for the motor 231 during a printing operation will be explained with reference to FIG. 7B. In the printing operation, the correction amount is changed in accordance with rotation phase areas area1 to area8 passing through the point A (see FIGS. 3A and 3B). In this case, the correction amount is updated in accordance with the fluctuation in radius of the roll RL. FIG. 7B shows a processing example pertaining to the update of the correction amount.

In step S31, the conveyance of the sheet M in the printing operation is started. In this step, the conveyance roller 221 and rotating shaft 21*c* are rotated by driving the motors 223 and 231, thereby performing the forward feed of the sheet M.

In step S32, when rotation phase areas area1 to area8 which pass through the point A (see FIGS. 3A and 3B) are switched, an area which passes through the point A after the switching is specified. The specified area will be called a target area. Note that processing may also be performed by fixing the position of the point A, but it is also possible to successively calculate the position of the point A in accordance with the change in radius of the roll RL, as described in the first embodiment.

In step S33, the sensing results of the sensors 24 and 25 are acquired, and the radius of the roll RL is calculated from above-mentioned equation (1) for the target area specified in step S32.

In step S34, the reliability of the radius of the roll RL calculated in step S33 is determined. If it is determined that there is reliability, the process advances to step S35. If it is determined that there is no reliability, the processing of one unit is terminated. The reliability is determined for the same reason as that described in the first embodiment. If it is determined that there is no reliability, processes in steps S35 and S36 to be described below are not performed, that is, the radius information and correction amount information are not updated.

In step S35, the correction amount of the target area is updated based on the radius of the roll RL calculated in step S33. In this step, the correction table corresponding to the sheet M is read out, and a correction amount is determined from the radius of the roll RL calculated in step S33. In step S36, the radius information and correction amount information of the target area stored in the storage unit 42 are updated by the radius calculated in step S33 and the correction amount updated in step S35. While the target area is passing through the point A, the control amount for the motor 223 is corrected by the updated correction amount for one distance unit. Thus, the processing of one unit is complete. During the printing operation, the process shown in FIG. 7B is repetitively executed, and the correction amount for each rotation phase area is updated one after another.

In this embodiment as explained above, the control amount for the motor 223 is set in accordance with the rotation phase during one rotation of the roll RL. Even when the tension fluctuation of the sheet M occurs during one rotation of the roll RL, therefore, the actual conveyance amount of the sheet M per one distance unit can be held constant. This makes it possible to increase the conveyance accuracy of the sheet M. Consequently, a conveyance shift decreases, and the quality of an image formed by the printing mechanism 3 can also be improved.

Other Embodiments

The present invention is applied to a printing apparatus in each of the above-mentioned embodiments, but the application field of the present invention is not limited to this, and the present invention is applicable to various conveying apparatuses which pull out a sheet from a roll in which the sheet is wound and convey the sheet, or to various kinds of sheet feed.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefits of Japanese Patent Application No. 2014-131800, filed Jun. 26, 2014, which is hereby incorporated by reference herein in its entirety.

What is claimed is:

1. A conveying apparatus comprising:

a supporting unit configured to rotatably support a roll around which a sheet is wound;

a conveying unit configured to convey the sheet pulled out from the roll supported by the supporting unit;

a detection unit configured to detect a rotation amount of the roll supported by the supporting unit;

a driving unit configured to give a rotational driving force to the roll supported by the supporting unit, the driving unit comprising a motor and a transfer mechanism configured to transfer an output from the motor to the roll; and a control unit configured to control the driving unit based on a detection result of the detection unit, wherein the control unit sets a control amount for the driving unit in accordance with a rotation phase of the roll in order to adjust a tension of the sheet between the roll and the conveying unit, and the control unit sets the control amount for each of a plurality of rotation phase areas obtained by dividing an angle range of one rotation of the roll.

2. The apparatus according to claim 1, wherein a deceleration ratio of the transfer mechanism is an integer, and the rotation phase areas are set by dividing the angle range into a plurality of areas by the deceleration ratio.

3. The apparatus according to claim 1, wherein the conveying unit comprises a roller configured to convey the pulled-out sheet, the detection unit comprises a first rotary encoder configured to detect a rotation phase of the roll supported by the supporting unit, the apparatus further comprises a second rotary encoder configured to detect a rotation phase of the roller, and the control unit calculates one of an eccentricity of a rotation center of the roll supported by the supporting unit or a radius of the roll, based on the detection result of the first rotary encoder and a detection result of the second rotary encoder, and sets the control amount based on the calculated value.

4. The apparatus according to claim 1, wherein the control unit sets the control amount for the conveying unit in accordance with a rotation phase based on the detection result of the detection unit.

5. The apparatus according to claim 4, wherein the control unit controls the driving unit such that the tension of the sheet becomes a predetermined value.

6. A printing apparatus comprising:

a conveying apparatus; and a printing unit configured to perform printing on a sheet fed from a roll by the conveying apparatus, wherein the conveying apparatus comprises:

a supporting unit configured to rotatably support a roll around which a sheet is wound;

a conveying unit configured to convey the sheet pulled out from the roll supported by the supporting unit;

a detection unit configured to detect a rotation amount of the roll supported by the supporting unit;

a driving unit configured to give a rotational driving force to the roll supported by the supporting unit, the driving unit comprising a motor and a transfer mechanism configured to transfer an output from the motor to the roll; and a control unit configured to control the driving unit based on a detection result of the detection unit, wherein the control unit sets a control amount for the driving unit in accordance with a rotation phase of the roll, in order to adjust a tension of the sheet between the roll and the conveying unit, and the control unit sets the control amount for each of a plurality of rotation phase areas obtained by dividing an angle range of one rotation of the roll.

7. A conveying apparatus comprising:

a supporting unit configured to rotatably support a roll around which a sheet is wound;

a conveying unit configured to convey the sheet pulled out from the roll supported by the supporting unit;

a detection unit configured to detect a rotation amount of the roll supported by the supporting unit; and a control unit configured to control the conveying unit based on the detection result of the detection unit, wherein the control unit sets a control amount for the conveying unit in accordance with a rotation phase of the roll, and the control unit sets the control amount for each of a plurality of rotation phase areas obtained by dividing an angle range of one rotation of the roll.

8. The apparatus according to claim 7, wherein the conveying unit comprises a roller configured to convey the pulled-out sheet, the detection unit comprises a first rotary encoder configured to detect a rotation phase of the roll supported by the supporting unit, the apparatus further comprises a second rotary encoder configured to detect a rotation phase of the roller, and the control unit calculates one of an eccentricity of a rotation center of the roll supported by the supporting unit and a radius of the roll based on the detection result of the first rotary encoder and a detection result of the second rotary encoder, and sets the control amount based on the calculated value.

9. The apparatus according to claim 7, wherein the control unit controls the conveying unit such that a conveyance amount of the sheet conveyed by the conveying unit becomes a predetermined conveyance amount.

10. A printing apparatus comprising:

a conveying apparatus; and a printing unit configured to perform printing on a sheet fed from a roll by the conveying apparatus, wherein the conveying apparatus comprises:

a supporting unit configured to rotatably support a roll around which a sheet is wound;

a conveying unit configured to convey the sheet pulled out from the roll supported by the supporting unit;

a detection unit configured to detect a rotation phase of the roll supported by the supporting unit; and a control unit configured to control the conveying unit based on a detection result of the detection unit, wherein the control unit sets a control amount for the conveying unit in accordance with a rotation phase of the roll, and the control unit sets the control amount for each of a plurality of rotation phase areas obtained by dividing an angle range of one rotation of the roll.

11. A sheet feeding method of feeding a sheet from a rotatably supported roll, comprising changing one of a back tension or a conveyance control amount of the fed sheet such that a fluctuation in tension of the sheet reduces, in accordance with a rotation phase during one rotation of the supported roll.

* * * * *